US010297215B2

(12) United States Patent
Chen et al.

(10) Patent No.: US 10,297,215 B2
(45) Date of Patent: May 21, 2019

(54) LIQUID CRYSTAL DISPLAY PANEL HAVING ALTERNATE POLARITIES FOR PAIRS OF PIXELS IN COLUMN AND LIQUID CRYSTAL DISPLAY DEVICE HAVING THE SAME

(71) Applicant: Shenzhen China Star Optoelectronics Technology Co., Ltd., Shenzhen, Guangdong (CN)

(72) Inventors: Shuai Chen, Guangdong (CN); Mengmeng Zhang, Guangdong (CN); Liyang An, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/737,253

(22) PCT Filed: Aug. 28, 2017

(86) PCT No.: PCT/CN2017/099242

§ 371 (c)(1),
(2) Date: Dec. 15, 2017

(87) PCT Pub. No.: WO2019/024156

PCT Pub. Date: Feb. 7, 2019

(65) Prior Publication Data

US 2019/0043434 A1 Feb. 7, 2019

(30) Foreign Application Priority Data

Aug. 3, 2017 (CN) ..... 2017 1 0654355

(51) Int. Cl.
*G09G 3/36* (2006.01)

(52) U.S. Cl.
CPC ..... *G09G 3/3614* (2013.01); *G09G 3/3607* (2013.01); *G09G 2300/0452* (2013.01); *G09G 2310/08* (2013.01); *G09G 2320/0219* (2013.01)

(58) Field of Classification Search
CPC ..... G09G 3/3611–3/3696; G09G 2300/0823; G09G 2310/0254–2310/0256
See application file for complete search history.

(56) References Cited

U.S. PATENT DOCUMENTS 6,545,653 B1 * 4/2003 Takahara ..... G02F 1/1334 345/100
2004/0239602 A1 * 12/2004 Kim ..... G09G 3/3611 345/87

(Continued)

FOREIGN PATENT DOCUMENTS

CN 1652187 A 8/2005
CN 101271207 A 9/2008

(Continued)

*Primary Examiner* — Sanghyuk Park
(74) *Attorney, Agent, or Firm* — Andrew C. Cheng

(57) ABSTRACT

The present disclosure provides a liquid crystal display panel composed of red pixel units, green pixel units and blue pixel units that are arranged in the form of matrix. Every adjacent two rows of pixel units form a pixel-unit group. Polarities of pixel units located at the same column in the same pixel-unit group are the same, and polarities of pixel units located at the same column in adjacent two pixel-unit groups are opposite, thus solving problem of color shift at large viewing angles. Polarities of adjacent red pixel units in each row of pixel units are alternately changed and polarities of adjacent blue pixel units in each row of the pixel units are alternately changed to alleviate grainy effect generated on the entire display image, thereby display effect is greatly (Continued)

enhanced. The present disclosure also provides a liquid crystal display device having the liquid crystal display panel.

6 Claims, 3 Drawing Sheets

(56) References Cited

U.S. PATENT DOCUMENTS

| | | | | |
|---|---|---|---|---|
| 2006/0267897 | A1 | 11/2006 | Lin | |
| 2007/0262310 | A1* | 11/2007 | Park | G09G 3/3659 257/59 |
| 2011/0037760 | A1* | 2/2011 | Kim | G09G 3/3614 345/214 |

FOREIGN PATENT DOCUMENTS

| | | | |
|---|---|---|---|
| CN | 101819366 | A | 9/2010 |
| CN | 104575431 | A | 4/2015 |
| CN | 105869597 | A | 8/2016 |

* cited by examiner

LIQUID CRYSTAL DISPLAY PANEL HAVING ALTERNATE POLARITIES FOR PAIRS OF PIXELS IN COLUMN AND LIQUID CRYSTAL DISPLAY DEVICE HAVING THE SAME

CROSS REFERENCE TO RELATED APPLICATIONS

The present application claims the benefit of the priority of Chinese Patent Application No. 201710654355.6, filed on Aug. 3, 2017, and entitled "LIQUID CRYSTAL DISPLAY PANEL AND LIQUID CRYSTAL DISPLAY DEVICE HAVING THE SAME", the disclosure of which is incorporated by reference herein in its entirety for all purposes.

TECHNICAL FIELD

The present disclosure relates to the field of liquid crystal display technology, and more particularly to a liquid crystal display panel and a liquid crystal display device having the same.

BACKGROUND

In liquid crystal display panels, a vertical alignment (VA) display mode has become a common display mode for large-size liquid crystal display devices as its advantages of wide viewing angle, high contrast ratio, rubbing-free process and so on. However, there are two common problems in LCD display devices with the existing VA display mode as follows: (1) affected by voltage feed through; (2) having a color shift when viewed from a large angle. For the problem (1), the main solution is to increase storage capacitor (Cst) in size and common electrode voltage compensation. The amount of the voltage feed through can be reduced by increasing the storage capacitor in size. However, in related art, the storage capacitor is usually limited by conditions such as aperture ratio and cannot be made too large. In addition, the way of common electrode voltage compensation cannot compensate for voltages of all gray scales, as there exist significant differences in capacitance values of a liquid crystal capacitor (Clc) under different gray scales, and symmetric centers of positive and negative voltages in different gray scales are deviated from a common electrode voltage (CFcom) to varying degrees, which will cause that a potential difference Vlc applied to the liquid crystal capacitor in positive frame is not coincident with that in negative frame, resulting in certain differences in display brightness and generating grainy effect in picture quality.

In response to the problem (2), a specific driving manner is usually used to solve the problem of color shift at the large viewing angles. Referring to FIG. 1, FIG. 1 is a driving manner in a related LCD display device. In this driving manner, four pixel units composing a display unit 10 on upper left, in adjacent four rows and four columns, i.e., 4*4 pixel units, are all positive (+); four pixel units composing a display unit 20 on upper right are all negative (−); four pixel units composing a display unit 30 on lower left are all negative (−); and four pixel units composing a display unit 40 on lower right are all positive (+). In this driving mode, polarities of adjacent red (R) pixel units, green (G) pixel units, or blue (B) pixel units in the same row are sequentially reversed in the following manner+, −, −, + or −, −, +, +. That is, in the related driving mode, the polarities of pixel units of the same color in each row are reversed by two pixel units as one period, for example, the polarities of adjacent two red pixel units in each row are +, and the polarities of the other adjacent two red pixel units are −. The reversal of the polarities of the red pixel units is repeated in such a manner. However, when adjacent two or more pixel units with the same color have the same polarities, the symmetrical centers of the positive and negative voltages in different gray scales may deviate from the common electrode voltage to varying degrees, resulting in certain differences in the display brightness, and generating the grainy effect in the picture quality due to uneven brightness, thereby affecting the viewing effect. It can be seen, in the related liquid crystal display panel, the driving manner can solve the problem of color shift at the large viewing angles, but cannot alleviate the grainy effect on display image caused by the voltage feed through.

SUMMARY

Embodiments of the present disclosure provide a liquid crystal display panel and a liquid crystal display device having the liquid crystal display panel, which can not only solve problem of color shift at large viewing angles, but also can alleviate grainy effect caused by voltage feed through as much as possible, thereby enhancing display effect.

In a first aspect, embodiments of the present disclosure provide a liquid crystal display panel including a pixel-unit array, a plurality of data lines and a plurality of scan lines.

The pixel-unit array is composed of red pixel units, green pixel units and blue pixel units, wherein, the red pixel units, the green pixel units and the blue pixel units are arranged in the form of matrix, and every adjacent two rows of pixel units form a pixel-unit group.

Each of the data lines is connected to a column of pixel units in the pixel-unit array and configured to provide data signals to the pixel units connected to the data lines.

Each of the scan lines is connected to a row of pixel units in the pixel-unit array and configured to provide scan signals to the pixel units connected to the scan lines.

Under the control of the data lines and the scan lines, polarities of the pixel units located at the same column in each pixel-unit group are the same, the polarities of the pixel units located at the same column and in adjacent two pixel-unit groups are opposite, the polarities of adjacent red pixel units in each row of pixel units change alternately, and the polarities of adjacent blue pixel units in each row of the pixel units change alternately.

The pixel-unit array is formed by sequentially and repeatedly arranging a red pixel unit, a green pixel unit, and a blue pixel unit along a row direction.

Twelve pixel units of the pixel units of each row in the pixel-unit array are taken as a period, polarities of the twelve pixel units of each row in one pixel-unit group are sequentially reversed in the following manner: positive, positive, negative, negative, positive, positive, positive, negative, negative, negative, negative and positive; polarities of twelve pixel units of each row in adjacent pixel-unit group are sequentially reversed in the following manner: negative, negative, positive, positive, negative, negative, negative, positive, positive, positive, positive and negative.

Twelve pixel units of the pixel units of each row in the pixel-unit array are taken as a period, polarities of the twelve pixel units of each row in one pixel-unit group are sequentially reversed in the following manner: positive, positive, positive, negative, positive, negative, positive, negative, positive, negative, negative and negative; polarities of twelve pixel units of each row in adjacent pixel-unit group are sequentially reversed in the following manner: negative, negative, negative, positive, negative, positive, negative, positive, negative, positive, positive and positive.

In another aspect, the present disclosure also provides a liquid crystal display device that includes a liquid crystal display panel, a scan driving unit and a data driving unit, wherein the scan driving unit and the data driving unit are electrically connected to the liquid crystal display panel respectively. The liquid crystal display panel includes a pixel-unit array, a plurality of data lines and a plurality of scan lines.

The pixel-unit array is composed of red pixel units, green pixel units and blue pixel units, wherein, the red pixel units, the green pixel units and the blue pixel units are arranged in the form of matrix, and every adjacent two rows of pixel units form a pixel-unit group.

The plurality of data lines are connected to the data driving unit. Each of the data lines is connected to a column of pixel units in the pixel-unit array and used for providing data signals to the pixel units connected to the data lines.

The plurality of scan lines are connected to the scan driving unit. Each of the scan lines is connected to a row of pixel units in the pixel-unit array and used for providing scan signals to the pixel units connected to the scan lines.

The scan driving unit is configured to provide scan driving signals to the scan lines, and the data driving unit is configured to provide data driving signals to the data lines.

Under the control of the data lines and the scan lines, polarities of the pixel units located at the same column in each pixel-unit group are the same, and the polarities of the pixel units located at the same column and in adjacent two pixel-unit groups are opposite; the polarities of adjacent red pixel units in each row of pixel units change alternately, and polarities of adjacent blue pixel units in each row of the pixel units change alternately.

The pixel-unit array is formed by sequentially and repeatedly arranging a red pixel unit, a green pixel unit, and a blue pixel unit along a row direction.

Twelve pixel units of the pixel units of each row in the pixel-unit array are taken as a period, polarities of the twelve pixel units of each row in one pixel-unit group are sequentially reversed in the following manner: positive, positive, negative, negative, positive, positive, positive, negative, negative, negative, negative and positive; polarities of twelve pixel units of each row in adjacent pixel-unit group are sequentially reversed in the following manner: negative, negative, positive, positive, negative, negative, negative, positive, positive, positive, positive and negative.

Twelve pixel units of the pixel units of each row in the pixel-unit array are taken as a period, polarities of the twelve pixel units of each row in one pixel-unit group are sequentially reversed in the following manner: positive, positive, positive, negative, positive, negative, positive, negative, positive, negative, negative and negative; polarities of twelve pixel units of each row in adjacent pixel-unit group are sequentially reversed in the following manner: negative, negative, negative, positive, negative, positive, negative, positive, negative, positive, positive and positive.

The liquid crystal display device further includes a timing control unit that is electrically connected to the scan driving unit and the data driving unit. The timing control unit is configured to control the scan driving unit to scan the liquid crystal display panel and to control the data driving unit to drive the liquid crystal display panel for displaying an image.

Under the control of the data lines and the scan lines, the polarities of the pixel units located at the same column in each pixel-unit group are the same, and the polarities of the pixel units located at the same column and in adjacent two pixel-unit groups are opposite, and the polarities of adjacent green pixel units in each row of the pixel units are reversed by taking two green pixel units as a period.

The liquid crystal display panel and the liquid crystal display device provided in the embodiments of the present disclosure can not only solve the problem of color shift at the large viewing angles, but also can alternately change the polarities of each row of the adjacent red pixel units and adjacent blue pixel units, thereby alleviating the grainy effect generated in the image as the red pixel units and the blue pixel units are affected by the voltage feed through, namely, alleviating the grainy effect generated in the entire display image, therefore, the display effect is greatly enhanced finally.

BRIEF DESCRIPTION OF THE DRAWINGS

In order to better illustrate the technical solutions embodied by the embodiments of the disclosure or by the related art, the accompanying drawings for use with description of the embodiments or the related art are briefly described below. It will be apparent that the drawings described in the following represent merely some embodiments of the disclosure, and that those of ordinary skill in the art will be able to obtain other drawings from these drawings without performing any creative work.

DETAILED DESCRIPTION OF ILLUSTRATED EMBODIMENTS

Figure 1:
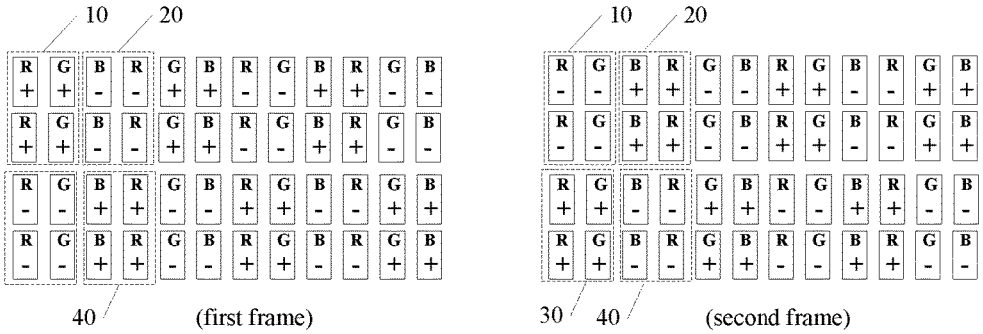
FIG. 1 (Prior Art)
FIG. 1 illustrates a schematic diagram of pixel polarities in a liquid crystal display panel configured to solve color shift at large viewing angles in related art.

The technical solutions in the embodiments of the present disclosure will be described clearly and completely hereinafter with reference to the accompanying drawings in the embodiments of the present disclosure. Evidently, the described embodiments are merely part, but not all, of the embodiments of the present disclosure. All other embodiments, which can be derived by persons of ordinary skills in the art based on the embodiments of the present disclosure without any inventive efforts, shall fall in the protection scope of the present disclosure.

As used herein, it should be noted that the terms "install", "connect" and "couple" should be broadly understood unless otherwise expressly stated and defined. For example, may be a fixed connection, may also be detachably connected, or integrally connected; may be a mechanical connection; may be directly connected, may also be indirectly connected through the intermediate medium, can be two components of the internal communication. It will be apparent to those skilled in the art that the specific meaning of the above terms in the present disclosure may be understood in particular.

In addition, in the description of the present disclosure, the meaning of "plurality" is two or more, unless otherwise indicates. If the term "process" appears in the summary, it refers not only to an independent process, but also to the term as long as the desired effect of the process is achieved when it is not clearly distinguishable from other processes. The numerical range indicated by "~" in the summary means a range in which the values described before and after "~" are included as the minimum value and the maximum value, respectively. In the accompanying drawing, units having similar or identical structures are denoted by the same reference numerals.

Embodiments of the present disclosure provide a liquid crystal display panel and a liquid crystal display device having the liquid crystal display panel, which can not only solve color shift problem at large viewing angles but also can alleviate grainy effect in an image caused by voltage feed through, thereby enhancing display effect. A detailed description is given below.

Figure 2:
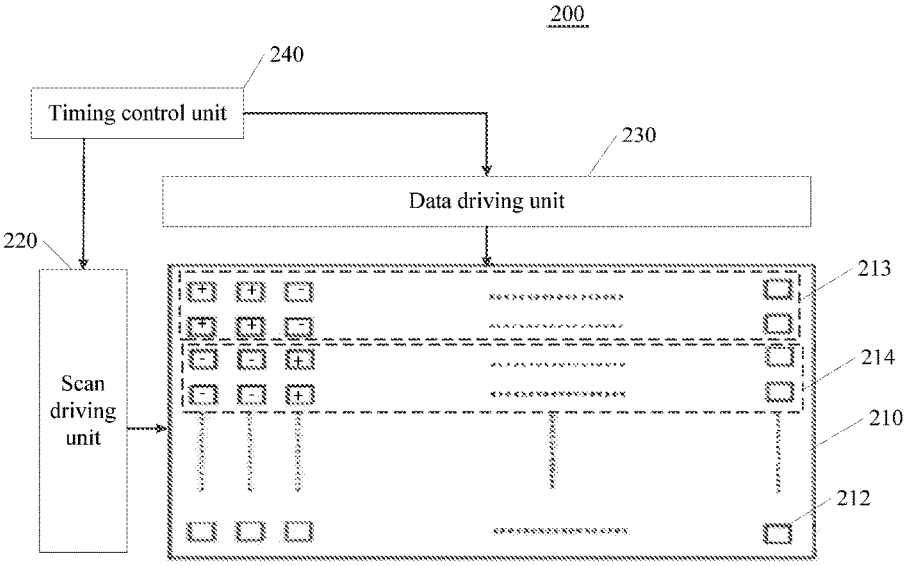
FIG. 2 illustrates a schematic diagram of a liquid crystal display device in the disclosure.

Referring to FIG. 2, FIG. 2 is a schematic diagram of a liquid crystal display device 200 in accordance with the present embodiment. The liquid crystal display device 200 includes a liquid crystal display panel 210, a scan driving unit 220, a data driving unit 230 and a timing control unit 240.

The scan driving unit 220 and the data driving unit 230 are electrically connected to the liquid crystal display panel 210, respectively. The timing control unit 240 is electrically connected to the scan driving unit 220 and the data driving unit 230 and used to control the scan driving unit 220 to scan the liquid crystal display panel 210. The timing control unit 240 is further used to control the data driving unit 230 to drive the liquid crystal display panel 210 for displaying an image.

Referring to FIG. 2, the liquid crystal display panel 210 of the present disclosure includes a plurality of data lines (not shown), a plurality of scan lines (not shown), and a pixel-unit array composed of pixel units 212. The data lines are connected to the data driving unit 230 and a column of the pixel units in the pixel-unit array, and are used to provide data signals to connected pixel units under the control of the data driving unit 230. The scan lines are connected to the scan driving unit 220 and a row of the pixel units in the pixel-unit array, and are used to provide scan signals to connected pixel units under the control of the scan driving unit 220. The pixel-unit array is formed by sequentially and repeatedly arranging a red pixel unit, a green pixel unit, a blue pixel unit along a row direction, and every adjacent two rows of the pixel units in the pixel-unit array forms a pixel-unit group. In each pixel-unit group, polarities of two pixel units 212 located at the same column are the same, and in adjacent two pixel-unit groups, polarities of adjacent two pixel units 212 in the same column and respectively located at the adjacent two pixel-unit groups are opposite, that is, in the same column, the polarity of the pixel unit 212 in one pixel-unit group is opposite to the polarity of the pixel unit 212 in the adjacent pixel-unit group, thereby solving the problem of color shift at large viewing angles. For example, as shown in FIG. 2, for the sake of convenience of explanation, adjacent two rows of the pixel units in the pixel-unit array are defined as a first pixel-unit group 213, and another adjacent two rows of the pixel units in the pixel-unit array are defined as a second pixel-unit group 214, wherein the second pixel-unit group 214 is adjacent to the first pixel-unit group 213. It should be understood that, in the present embodiment, the pixel-unit array may further include a third pixel-unit group, a fourth pixel-unit group, a sixth pixel-unit group, and the like, and the number thereof is not specifically limited thereto. To facilitate description, the present embodiment will be described by taking the first pixel-unit group 213 and the second pixel-unit group 214 as an example.

Polarities of the two pixel units 212 located at a first column in the first pixel-unit group 213 are all positive (+). Polarities of the two pixel units 212 located at a first column in the second pixel-unit group 214 are the same that are negative (−) and are opposite to the polarities of the two pixel units 212 in the first column in the first pixel-unit group 213. Polarities of the two pixel units 212 in a second column in the first pixel-unit group 213 are all positive (+). Polarities of the two pixel units 212 in a second column in the second pixel-unit group 214 are the same that are negative (−) and are opposite to the polarities of the two pixel units 212 in the second column in the first pixel-unit group 213. Polarities of the two pixel units 212 in a third column in the first pixel-unit group 213 are all negative (−). Polarities of the two pixel units 212 in a third column in the second pixel-unit group 214 are the same that are positive (+) and are opposite to the polarities of the two pixel units 212 in the third column in the pixel-unit group 213. In addition, the pixel units of each row take twelve pixel units 212 as a period, polarities of adjacent red pixel units in the same period are opposite and polarities of adjacent blue pixel units in the same period are opposite, alleviating the grainy effect generated in the image as the red pixel units and the blue pixel units are affected by the voltage feed through as much as possible.

Figure 3:
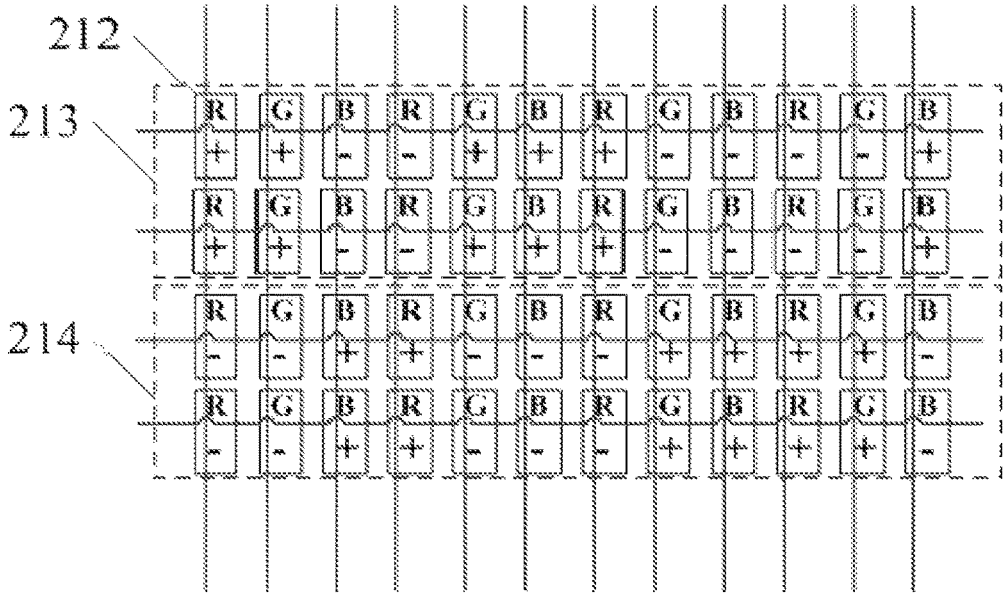
FIG. 3 illustrates a schematic diagram of a liquid crystal display panel in accordance with a first embodiment of the disclosure.

Referring to FIG. 3, FIG. 3 is illustrates a schematic diagram of a liquid crystal display panel 210 in accordance with a first implementation of the disclosure. In the first embodiment of the present disclosure, the display panel of the present embodiment will be described with reference to a 4*12 pixel-unit array (including the first pixel-unit group 213 and the second pixel-unit group 214, each pixel-unit group includes 2*12 pixel units), twelve data lines, and four scan lines.

In the implementation of the present disclosure, there are four red pixel units, four green pixel units, and four blue pixel units, which are formed by sequentially and repeatedly arranging a red pixel unit (R), a green pixel unit (G), and a blue pixel unit (B) along a row direction. Each of the data lines is connected to the pixel units located at the same column, and each of the scan lines is connected to the pixel units located at the same row. The scan lines are connected to the scan driving unit 220 (as shown in FIG. 1), and the data lines are connected to the data driving unit 230 (shown in FIG. 1). The scan lines driven by the scan driving unit 220 output scan signals to each of the connected pixel units, and the data lines driven by the data driving unit 230 output data signals to each of the connected pixel units, so that polarities of the pixel units in the same column of the same pixel-unit group (the first pixel-unit group 213 or the second pixel-unit group 214) are the same, and polarities of the pixel units in the same column in adjacent pixel-unit group (the second pixel-unit group 214 or the first pixel-unit group 213) are opposite. In addition, polarities of twelve pixel units in each row of one pixel-unit group (e.g., the first pixel-unit group 213 composed of a first row and a second row of the pixel units) are sequentially reversed in the following manner: positive, positive, negative, negative, positive, positive, positive, negative, negative, negative, negative, positive, and polarities of twelve pixel units in each row of adjacent pixel-unit group (e.g., the second pixel-unit group 214 composed of a third and a fourth row of the pixels units) are sequentially reversed in the following manner: negative, negative, positive, positive, negative, negative, negative, positive, positive, positive, positive, negative.

In the liquid crystal display panel 210 of the implementation of the present disclosure, polarities of pixel units of each two rows in the pixel-unit array acting as one pixel-unit group is reversed, which can solve the color shift problem at the large viewing angles. In addition, the polarities of adjacent red pixel units in each row of pixel units may change alternately, and the polarities of adjacent blue pixel units in each row of the pixel units may also change alternately. For example, in the 4*12 pixel-unit array, polarities of red pixel units in each row of the first pixel-unit group 213 are sequentially reversed as follows: positive (+), negative (−), positive (+), negative (−), and polarities of blue pixel units in each row of the first pixel-unit group 213 are sequentially reversed as follows: negative (−), positive (+), negative (−), positive (+). Polarities of red pixel units in each row of the second pixel-unit group 214 are sequentially reversed as follows: negative (−), positive (+), negative (−), positive (+), and polarities of blue pixel units in each row of the second pixel-unit group 214 are sequentially reversed as follows: positive (+), negative (−), positive (+), negative (−). This kind of polarity-alternation changing manner can greatly mitigate the grainy effect cause by the pixel units due to the voltage feed through. The specific principles are as follows: assuming that the red pixel units having a positive (+) polarity would contribute to the grainy effect on the display image due to the influence of the voltage feed through, if the red pixel units having the positive (+) polarity that would cause the grainy effect on the display image can be uniformly distributed in the pixel-unit array, that is, the red pixel units with positive (+) polarity and the red pixel units with negative (−) polarity are alternately arranged, which can apparently mitigate the grainy effect caused by the red pixel units due to the voltage feed through. In contrast, if the red pixel units having the positive (+) polarity that would cause the grainy effect on the display image are collectively distributed in the pixel-unit array, that is, two or more red pixel units having the positive (+) polarity are arranged adjacent to each other, which is equivalent to gather multiple particles together on the display image, thus the grainy effect caused by the red pixel units due to the voltage feed through cannot be reduced.

In the liquid crystal display panel 210 of the implementation of the present disclosure, polarities of adjacent green pixel units are not alternately changed, but the polarity reversal is performed by two green pixel units as a period. For example, in the 4*12 pixel-unit array, polarities of green pixel units of each row in the first pixel-unit group 213 are as follows: positive (+), positive (+), negative (−), negative (−), and polarities of green pixel units of each row in the second pixel-unit group 214 are as follows: negative (−), negative (−), positive (+), positive (+). This kind of polarity reversal manner cannot mitigate the grainy effect caused by the green pixel units due to the influence of the voltage feed through, but human eyes are insensitive to a brightness difference existing in high gray scale color (e.g., green), and more sensitive to the brightness difference in low gray scale color (e.g., red, blue). Therefore, the display panel of the present embodiment cannot mitigate the grainy effect caused by the green pixel units, but that caused by the red pixel units and the blue pixel units has been greatly mitigated, so that the grainy effect caused by the voltage feed through can be greatly eliminated in the display image.

The liquid crystal display panel 210 of the present embodiment can not only solve the problem of color shift at large viewing angles, but also alternately change the polarities of each row of the adjacent red pixel units and the adjacent blue pixel units, thereby alleviating the grainy effect generated in the image as the red pixel units and the blue pixel units are affected by the voltage feed through. Because the human eyes are only sensitive to the grainy effect generated by the pixel units (the red pixel units and the blue pixel units) in the low gray scale color. Therefore, as long as alleviating the grainy effect generated by the red pixel units and the blue pixel units, the grainy effect in entire display image can be alleviated, thus enhancing the overall display effect of the liquid crystal display panel.

Figure 4:
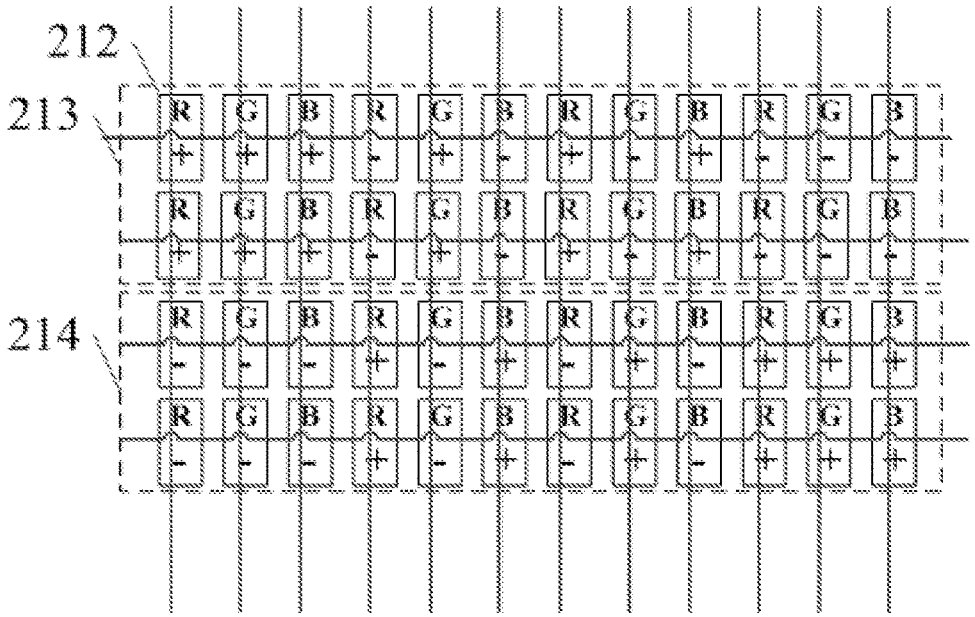
FIG. 4 illustrates a schematic diagram of a liquid crystal display panel in accordance with a second embodiment of the disclosure.

Referring to FIG. 4, FIG. 4 is a schematic diagram of a liquid crystal display panel 210 in accordance with a second implementation of the present disclosure. The liquid crystal display panel 210 of the present embodiment is similar to the liquid crystal display panel 210 of the first implementation, and the difference is that polarity reversal manners of the pixel units in the pixel-unit array are not the same. Specifically, taking the 4*12 pixel-unit array (e.g., the first pixel-unit group 213 and the second pixel-unit group 214, each pixel-unit group includes 2*12 pixel units) as an example, where the polarities of the twelve pixel units of each row in one pixel-unit group (e.g., the first pixel-unit group 213 composed of the pixel units in the first row and the second row) are sequentially reversed as follows: positive, positive, positive, negative, positive, negative, positive, negative, positive, negative, negative, negative (i.e., +, +, +, −, +, −, +, −, +, −, −, −), and the polarities of the twelve pixel units of each row in another adjacent pixel-unit group (e.g., the second pixel-unit group 214 composed of the pixel units in the third row and the fourth row) are sequentially reversed as follows: negative, negative, negative, positive, negative, positive, negative, positive, negative, positive, positive, positive (i.e., −, −, −, +, −, +, −, +, −, +, +, +).

In the liquid crystal display panel 210 according to the implementation of the present disclosure, the polarities of the pixel units in each two row of the pixel-unit array as one pixel-unit group is reversed, which can solve the problem of color shift at the large viewing angles. In addition, the polarities of the adjacent red pixel units in each row of the pixel units may alternately change, and the polarities of the adjacent blue pixel units may also alternately change. For example, in the 4*12 pixel-unit array, the polarities of the red pixel units in each row of the first pixel-unit group 213 are as follows: positive (+), negative (−), positive (+), negative (−), and the polarities of the blue pixel units in each row of the first pixel-unit group 213 are as follows: positive (+), negative (−), positive (+), negative (−). The polarities of the red pixel units in each row of the second pixel unit group 214 are as follows: negative (−), positive (+), negative (−), positive (+), and the polarities of the blue pixel units in each row of the second pixel unit group 214 are as follows: negative (−), positive (+), negative (−), positive (+). This kind of polarity-alternation changing manner can greatly alleviate the grainy effect caused by the pixel units due to the voltage feed through. Although the polarities of the adjacent green pixel units are not alternately changed, the human eyes are insensitive to the brightness difference existing in the high gray scale color (e.g., green pixel units), and more sensitive to the brightness difference in the low gray scale color (e.g., red pixel unit, blue pixel unit). Therefore, in the implementation, the grainy effect that may be caused by the red pixel units and the blue pixel units is mitigated, i.e., the grainy effect in the display image is greatly mitigated.

As mentioned above, the liquid crystal display device and the liquid crystal display panel 210 of the present embodiment can not only solve the problem of color shift at the large viewing angles, but also alternately change the polarities of each row of the adjacent red pixel units and adjacent blue pixel units, thereby, mitigating the grainy effect generated in the image as the red pixel units and the blue pixel units are affected by the voltage feed through, i.e., alleviating the grainy effect generated in entire display image, and finally, the display effect is greatly enhanced.

The display panel and the liquid crystal display device having the display panel can not only solve the problem of color shift at the large viewing angles, but also can eliminate the grainy effect present on the display image due to the voltage feed through as much as possible, thereby the display effect of the liquid crystal display panel is greatly improved.

In the description of this summary, the description of the terms "one embodiment", "some embodiments", "examples", "specific examples" or "some examples" and the like are intended to be a combination of the specific features described in connection with the embodiments or examples, structure, material, or characteristic is included in at least one embodiment or example of the present disclosure. In the present specification, the illustrative expression of the above-mentioned terminology does not necessarily refer to the same embodiment or example. Moreover, the particular features, structures, materials, or features described may be combined in any suitable embodiment or example in any suitable manner.

The display panel and the display device having the same have been described in detail with reference to the embodiments of the present disclosure, and the principles and embodiments of the present disclosure have been described with reference to specific examples, the description of the above embodiments is only intended to help understand the method of the disclosure and its core ideas. At the same time, it will be apparent to those skilled in the art that changes may be made in the embodiments and the scope of application in accordance with the teachings of the present disclosure, and the contents of this specification should not be construed as limiting the disclosure.

What is claimed is:

1. A liquid crystal display panel, comprising:

a pixel-unit array, composed of red pixel units, green pixel units and blue pixel units, wherein, the red pixel units, the green pixel units and the blue pixel units are arranged in the form of matrix, and every adjacent two rows of pixel units form a pixel-unit group;

a plurality of data lines, wherein each of the data lines is connected to a column of pixel units in the pixel-unit array and configured to provide data signals to the pixel units connected to the data lines;

a plurality of scan lines, wherein each of the scan lines is connected to a row of pixel units in the pixel-unit array and configured to provide scan signals to the pixel units connected to the scan lines;

wherein under control of the data lines and the scan lines, polarities of the pixel units located at the same column in each pixel-unit group are the same, the polarities of the pixel units located at the same column and in adjacent two pixel-unit groups are opposite, the polarities of adjacent red pixel units in each row of pixel units change alternately, and the polarities of adjacent blue pixel units in each row of the pixel units change alternately;

wherein the pixel-unit array is formed by sequentially and repeatedly arranging a red pixel unit, a green pixel unit, and a blue pixel unit along a row direction; and wherein twelve pixel units of the pixel units of each row in the pixel-unit array are taken as a period, polarities of the twelve pixel units of each row in one pixel-unit group are sequentially reversed in the following manner: positive, positive, negative, negative, positive, positive, positive, negative, negative, negative, negative and positive; polarities of twelve pixel units of each row in adjacent pixel-unit group are sequentially reversed in the following manner: negative, negative, positive, positive, negative, negative, negative, positive, positive, positive, positive and negative.

2. A liquid crystal display panel, comprising:

a pixel-unit array, composed of red pixel units, green pixel units and blue pixel units, wherein, the red pixel units, the green pixel units and the blue pixel units are arranged in the form of matrix, and every adjacent two rows of pixel units form a pixel-unit group;

a plurality of data lines, wherein each of the data lines is connected to a column of pixel units in the pixel-unit array and configured to provide data signals to the pixel units connected to the data lines;

a plurality of scan lines, wherein each of the scan lines is connected to a row of pixel units in the pixel-unit array and configured to provide scan signals to the pixel units connected to the scan lines;

wherein under the control of the data lines and the scan lines, polarities of the pixel units located at the same column in each pixel-unit group are the same, the polarities of the pixel units located at the same column and in adjacent two pixel-unit groups are opposite, the polarities of adjacent red pixel units in each row of pixel units change alternately, and the polarities of adjacent blue pixel units in each row of the pixel units change alternately;

wherein the pixel-unit array is formed by sequentially and repeatedly arranging a red pixel unit, a green pixel unit, and a blue pixel unit along a row direction; and wherein twelve pixel units of the pixel units of each row in the pixel-unit array are taken as a period, polarities of the twelve pixel units of each row in one pixel-unit group are sequentially reversed in the following manner: positive, positive, positive, negative, positive, negative, positive, negative, positive, negative, negative and negative; polarities of twelve pixel units of each row in adjacent pixel-unit group are sequentially reversed in the following manner: negative, negative, negative, positive, negative, positive, negative, positive, negative, positive, positive and positive.

3. A liquid crystal display device, comprising: a liquid crystal display panel, a scan driving unit and a data driving unit, the scan driving unit and the data driving unit electrically connected to the liquid crystal display panel; wherein the liquid crystal display panel comprises:

a pixel-unit array, composed of red pixel units, green pixel units and blue pixel units, wherein, the red pixel units, the green pixel units and the blue pixel units are arranged in the form of matrix, and every adjacent two rows of pixel units form a pixel-unit group;

a plurality of data lines connected to the data driving unit, each of the data lines being connected to a column of pixel units in the pixel-unit array and configured to provide data signals to the pixel units connected to the date lines;

a plurality of scan lines connected to the scan driving unit, each of the scan lines being connected to a row of pixel units in the pixel-unit array and configured to provide scan signals to the pixel units connected to the scan lines;

the scan driving unit configured to provide scan driving signals to the scan lines and the data driving unit configured to provide data driving signals to the data lines;

wherein, under control of the data lines and the scan lines, polarities of the pixel units located at the same column in each pixel-unit group are the same, the polarities of the pixel units located at the same column and in adjacent two pixel-unit groups are opposite, polarities of adjacent red pixel units in each row of pixel units change alternately, and polarities of adjacent blue pixel units in each row of the pixel units change alternately;

wherein the pixel-unit array is formed by sequentially and repeatedly arranging a red pixel unit, a green pixel unit, and a blue pixel unit along a row direction; and wherein twelve pixel units of the pixel units of each row in the pixel-unit array are taken as a period, polarities of the twelve pixel units of each row in one pixel-unit group are sequentially reversed in the following manner: positive, positive, negative, negative, positive, positive, positive, negative, negative, negative, negative and positive; polarities of twelve pixel units of each row in adjacent pixel-unit group are sequentially reversed in the following manner: negative, negative, positive, positive, negative, negative, negative, positive, positive, positive, positive and negative.

4. The liquid crystal display device of claim 3, further comprising a timing control unit that is electrically connected to the scan driving unit and the data driving unit; wherein the timing control unit is configured to control the scan driving unit to scan the liquid crystal display panel and to control the data driving unit to drive the liquid crystal display panel for displaying an image.

5. The liquid crystal display device of claim 3, wherein under the control of the data lines and the scan lines, the polarities of the pixel units located at the same column in each pixel-unit group are the same, and the polarities of the pixel units located at the same column and in adjacent two pixel-unit groups are opposite, and the polarities of adjacent green pixel units in each row of the pixel units are reversed by taking two green pixel units as a period.

6. The liquid crystal display device of claim 4, wherein the polarities of the pixel units located at the same column in each pixel-unit group are the same under the control of the data lines and the scan lines, the polarities of the pixel units located at the same column in the adjacent two pixel-unit groups are opposite, and polarities of the adjacent green pixel units in each row of the pixel units are reversed by taking two green pixel units as a period.

* * * * *